United States Patent [19]

Lesko et al.

[11] 3,935,413

[45] Jan. 27, 1976

[54] APPARATUS FOR STRESS RELIEVING SPRINGS AND THE LIKE

[75] Inventors: Richard Lesko, Harwinton; David Reynolds, Torrington, both of Conn.

[73] Assignee: Torin Corporation, Torrington, Conn.

[22] Filed: May 30, 1974

[21] Appl. No.: 474,370

[52] U.S. Cl. ..... 219/50; 219/153; 219/159

[51] Int. Cl.[2] ..... H05B 3/00

[58] Field of Search ..... 219/50, 153, 159

[56] References Cited

UNITED STATES PATENTS

| | | | |
|---|---|---|---|
| 1,826,207 | 10/1931 | Fassler | 219/159 X |
| 2,116,327 | 5/1938 | Simmons | 219/50 |
| 2,124,329 | 7/1938 | Zimmerman | 219/50 |
| 2,261,878 | 11/1941 | Hathaway | 219/50 X |
| 2,504,790 | 4/1950 | Barlow | 219/50 |
| 2,685,019 | 7/1954 | Druehl | 219/50 |
| 3,304,404 | 2/1967 | Goldmeyer et al. | 219/50 X |

*Primary Examiner*—J. V. Truhe
*Assistant Examiner*—N. D. Herkamp
*Attorney, Agent, or Firm*—McCormick, Paulding & Huber

[57] ABSTRACT

Apparatus comprising a rotary supporting table for moving circumaxial series of work holders in a predetermined circular path. Each work holder comprises an upright pin adapted to receive on and about itself a coil spring and a base member. The base member takes the form of an electrically conductive electrode part. At a loading station, springs are deposited successively on the pins and the table is indexed to move the pins and springs to a stress relieving station. Prior to the stress relieving station, a rotary brush engages the springs and indexes them about their pins to bring an end surface of an end coil into engagement with a small vertical abutment on the base member. The base members have inclined seating surfaces for the side surfaces of the end coils of the springs. At the stress relieving station, an upper electrode is moved into engagement with an upper-most coil of the spring to set the spring slightly and a second part of a lower electrode is moved into engagement with the electrically conductive base member or first electrode part. The spring is then resistance heated for stress relief and thereafter passes through a cooling tunnel having an air blower associated therewith. At a spring setting station, a vertically reciprocable ram engages each spring at an upper portion and compresses the spring about its supporting pin whereby to set the same. An unloading device is provided at an unloading station and comprises a caliper type spring gripping device which is slidable vertically and swingable horizontally through approximately 90°. The gripping device engages a spring and lifts the same from its supporting pin to thereupon swing it horizontally for discharge into an appropriate discharge chute.

13 Claims, 6 Drawing Figures

APPARATUS FOR STRESS RELIEVING SPRINGS AND THE LIKE

BACKGROUND OF THE INVENTION

Various stress relieving techniques have been employed in the past and stress relief of springs has been accomplished through electrical resistance heating. In the latter instance, the springs have been relieved while still attached to a spring coiler and prior to cut-off operation. That is, an electrode is engaged with a forward end coil of a spring and part of the spring coiler is employed as an opposite electrode. Such devices have not been wholly satisfactory in production operations.

SUMMARY OF THE INVENTION

It is the general object of the present invention to provide a stress relieving apparatus adapted for continuous and automatic operation and which is particularly suited to use in conjunction with a spring coiler to effect a continuous and integrated spring making process.

PREFERRED EMBODIMENT OF THE INVENTION

Figure 1:
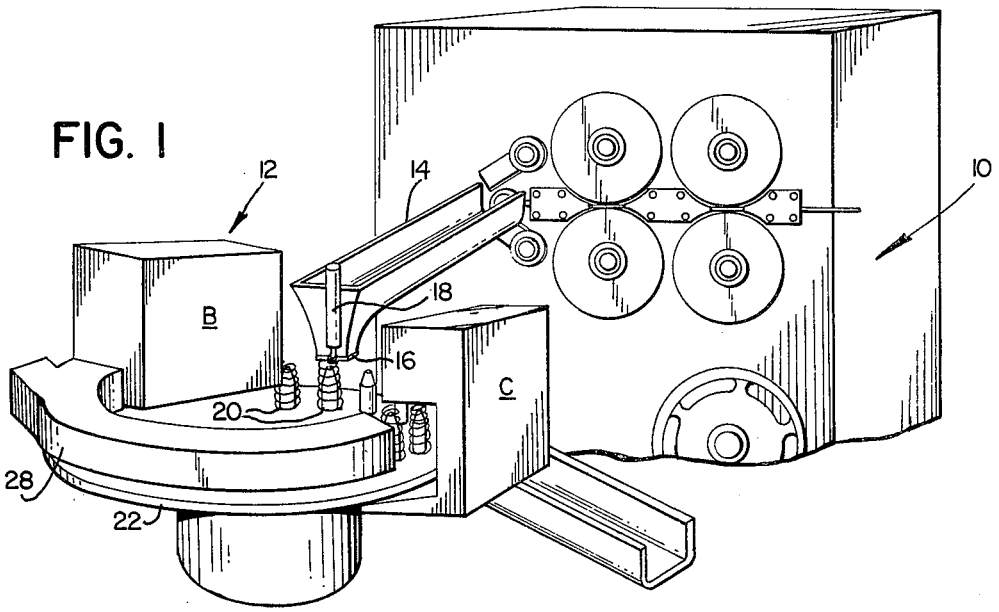
FIG. 1 is a somewhat schematic perspective view of the stress relieving apparatus of the present invention employed with a spring coiling machine.

Referring particularly to FIG. 1, it will be observed that a spring coiler is indicated generally at 10 in association with the stress relieving apparatus of the present invention indicated generally at 12. A delivery chute 14 extends from the spring coiler 10 and has a small flapper member 16 at a lower or delivery end thereof. The flapper 16 is operated by a fluid cylinder 18 successively to deliver springs from the coiler to the apparatus of the present invention at a loading station A, FIG. 2. A stress relieving station is provided at B, FIGS. 1 and 2, and a spring setting station at C. At D, an unloading station is provided and it will be apparent that all of said stations are positioned in a predetermined path of movement of a series of similar spring holders 20, 20. Said predetermined path of movement takes a circular form in accordance with the presently preferred practice and the holders 20, 20 are accordingly disposed atop a rotary supporting and indexing table 22. A first spring indexing means is provided at 24 in advance of the stress relieving station B and, preferably, a second spring indexing means is provided at 26 in advance of the spring setting station C. In the embodiment of the invention shown, a cooling means 28 is provided between the stress relieving station B and the spring setting station C. A stress relieving device is indicated generally at 30 at the station B, a spring setting device at 32 at the station C, an unloading device 34 at the station D and a discharge chute 36 also at and extending from the station D.

Figure 3:
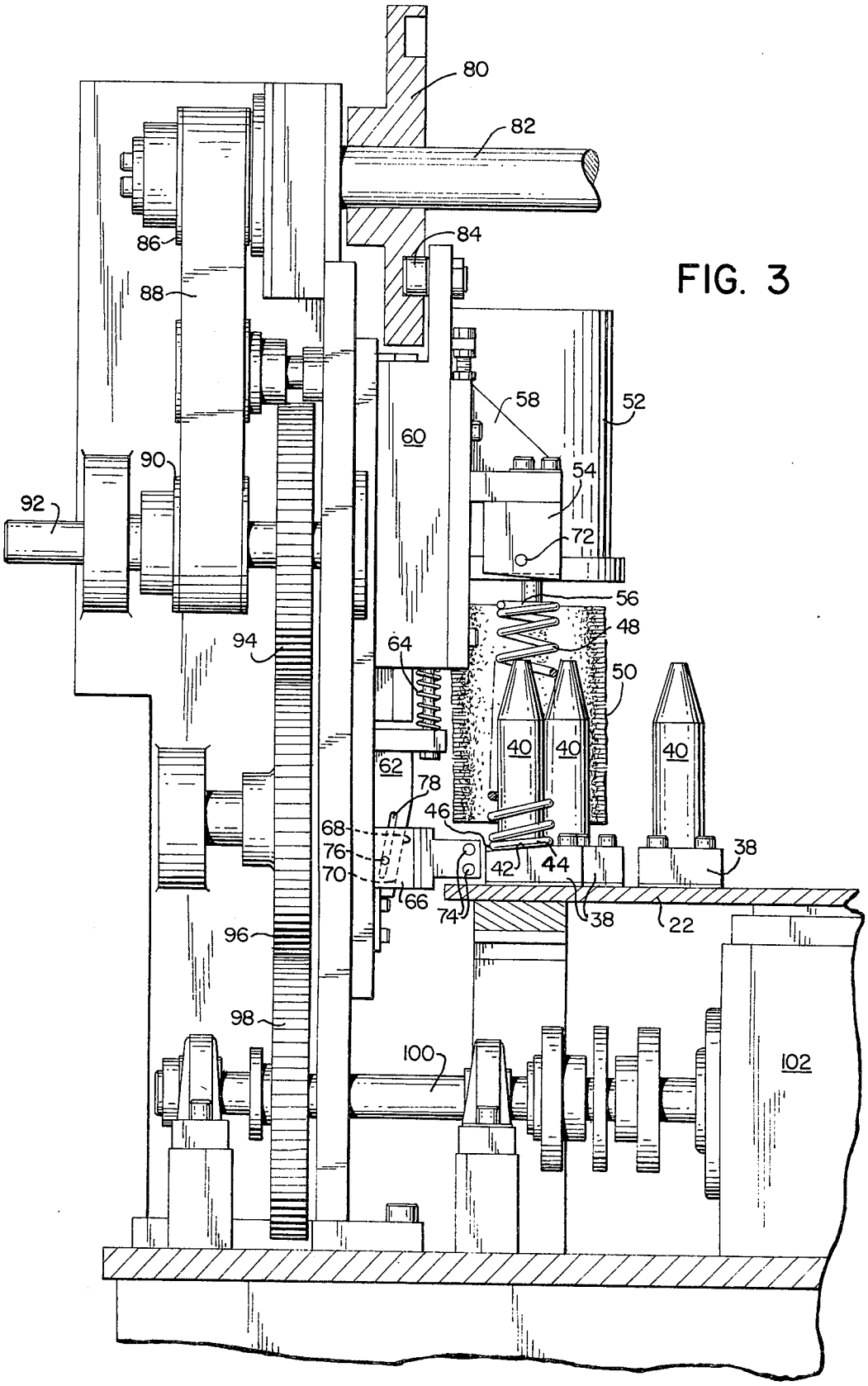
FIG. 3 is an enlarged vertical section taken generally as indicated at 3—3 in FIG. 2 and illustrating a stress relieving station.
Figure 4:
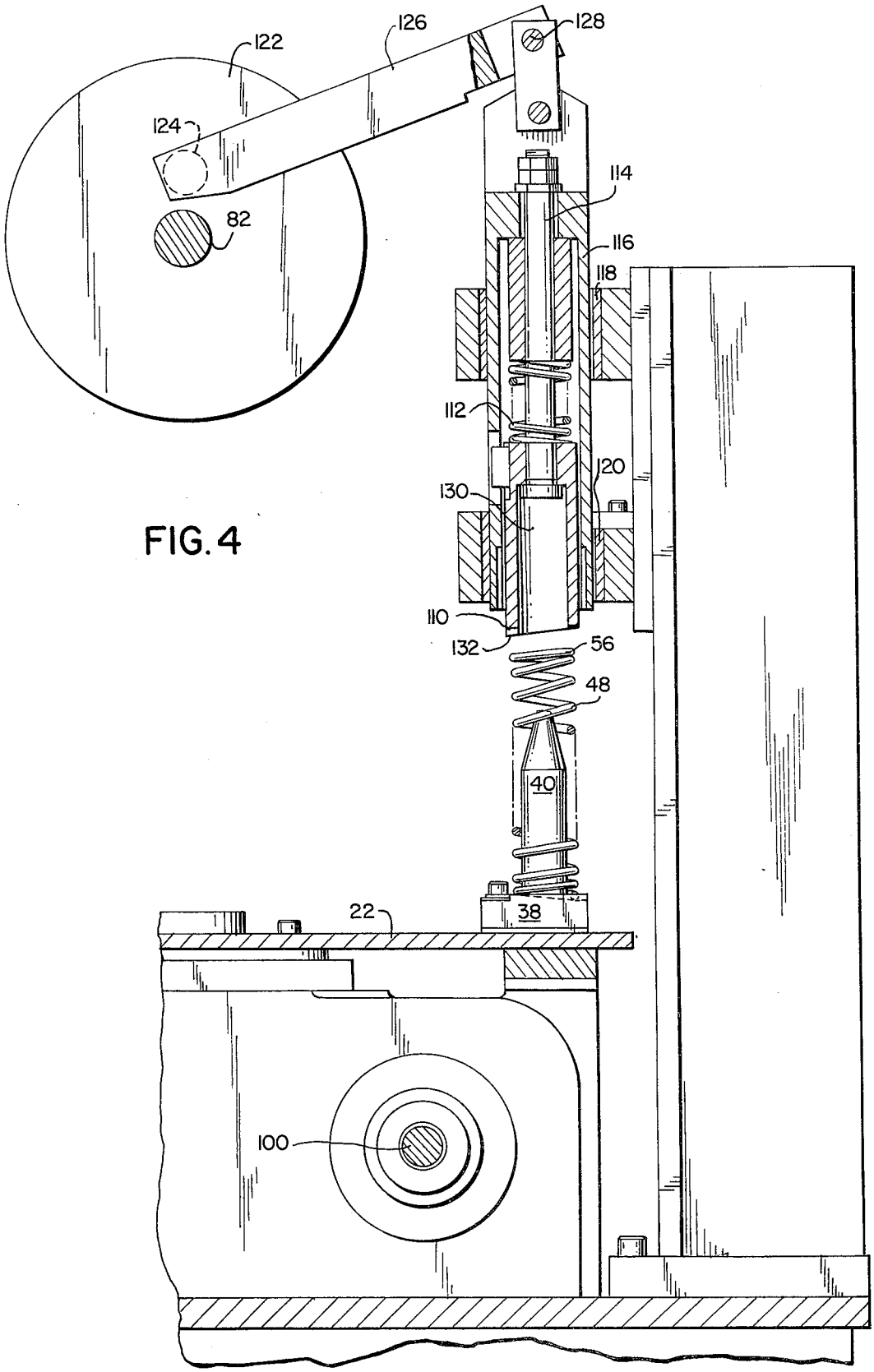
FIG. 4 is an enlarged vertical sectional view taken generally as indicated at 4—4 in FIG. 2 and illustrating a spring setting station.

Referring more particularly to FIG. 3, each of the holders 20, 20 comprises a base member 38 of electrically conductive material and which forms a part of a lower electrode and the stress relieving station B. Further, the holders comprise electrically nonconductive upright pins 40, 40 for receiving and supporting coil springs atop the base members 38, 38. Preferably, upper portions of the pins are cone-shaped to provide for ease of downward introduction of the coil springs thereto. As best illustrated at the left-hand base member 38 and in FIG. 3, an inclined seating surface 42 is provided on each of the base members 38 for engagement with a side surface of a lower-most coil 44 of a coil spring mounted on and about the pin 40. Further, a small vertical abutment 46 is provided adjacent the inclined surface 42 for engagement with the end surface of said lower-most coil 44. As will be apparent, a spring such as the spring 48 in FIG. 3 may be rotatably indexed to bring the end surface of its lower-most coil into engagement with the vertical abutment 46 and to seat the side surface of the said coil on the inclined surface 42.

The spring indexing devices 24 and 26 may vary widely in form but preferably each of said devices comprises a rotary element engageable with and operable to rotate springs such as 48 on the pins 40, 40. As best illustrated in FIG. 3, said elements take the form of rotary brushes, one shown, supported for rotation on vertical axes and driven by electrical motors such as the motor 52. The brushes 50, 50 are appropriately positioned to engage springs 48, 48 on the pins 40, 40 and to rotate the same in the desired direction. Any dislodgement of springs 48, 48 in passage through the cooling means 28 will be attended to by the second indexing means 26.

With a spring properly positioned after indexing as illustrated in FIG. 3, its lower surface, the side surface of the lower-most coil 44 engages the electrically conductive base member 38 and an upper electrode 54 may be lowered into engagement with an upper-most coil 56 of the spring. The electrode 54 is mounted by a suitable bracket 58 on a slide 60 which is vertically reciprocable and which carries a lower auxiliary slide 62. A spring connection between the two slides is provided for at 64 in the form of an override spring seated at an upper end on the slide 60 and at a lower end on the auxiliary slide 62. The auxiliary slide 62 carries a second part 66 of a lower electrode which cooperates with the first part or base member 38 of the lower electrode. That is, the electrode 66 is movable horizontally into and out of engagement with the base members 38 as they are indexed to the stress relieving station B. As will be apparent, downward movement of the slide 60 will bring the electrode 54 into engagement with an upper coil 56 and the spring may be slightly set for good electrical contact. Thereafter, continued downward movement of the slide 60 will cause the auxiliary slide 62 to urge the electrode 66 rightwardly under the influence of inclined complementary surfaces 68, 70 on the slide and the electrode. Rightward movement of the electrode 66 will bring the right-hand surface thereof into firm engagement with the base member 38 whereby to establish electrical contact. Electrical power and control means of a conventional type may be employed with the electrodes 54, 66 and 38, electrical connections being indicated schematically at 72 and 74. For an example, an appropriate transformer and a resistance welder-type controller may be utilized. When resistance heating and stress relief of the spring 48 is complete, the slide 60 is moved upwardly whereby to disengage the electrode 54 from the upper end coil 56 of the spring and the electrode 66 is withdrawn leftwardly by means of a pin slot device 76, 78.

Various conventional drive means may be employed for the slide 60, etc. and an illustrative means may comprise a cam 80 on a cam shaft 82 and having an associated follower 84 carried at an upper end portion of the slide 60. The cam shaft 82 is driven from a pulley 86 via a belt 88 and a second pulley 90. The pulley 90 is in turn rotatably driven by a shaft 92 which may extend from the spring coiler when the apparatus of the present invention is employed in direct association with such a coiler.

Gear means at 94, 96 and 98 also associated with the shaft 92 extend to a lower drive shaft 100 which in turn extends to a rotary indexing means 102 for the aforementioned table 22. The rotary indexing means 102 may be a conventional commercially available unit.

As mentioned above, a cooling means may be provided for stress relieved springs and a preferred means 28 comprises a cooling tunnel which has an associated air blower indicated in broken line form at 104, air inlets 106, 106, and a spring inlet end 108. The spring inlet end 108 is disposed adjacent the stress relieving station B and the tunnel is of arcuate configuration so as to provide for the passage of the springs therethrough in their arcuate path to the spring setting station C. In an illustrative example of stress relief and cooling, the springs leave the stress relieving station B in the neighborhood of 700°F and exit from the cooling tunnel 28 in the neighborhood of 200°F.

At the spring setting station C, a vertically reciprocable ram 110 is provided above a spring 48 disposed on and about a pin 40 atop a base member 38. The ram 110 has an associated override spring 112 and a drive rod 114 fixed in a slide 116 in turn vertically movable in upper and lower guideways 118, 120. The slide 116 is driven from a suitable cam 122 having a follower 124 at the left-hand end of an oscillable arm 126 in turn pivotally connected at a right-hand end 128 with the slide 116. The cam 122 may be mounted on the aforementioned cam shaft 82.

Referring again to the ram 110, it will be observed that the said ram is of tubular construction with a hollow interior at 130. Thus, in its downward travel the ram is adapted to slide about the pin 40 whereby to compress and to set the spring 48. Further, an inclined lower surface 132 is preferably provided for conformity with an upper or side surface of an upper-most spring coil 56.

Figure 2:
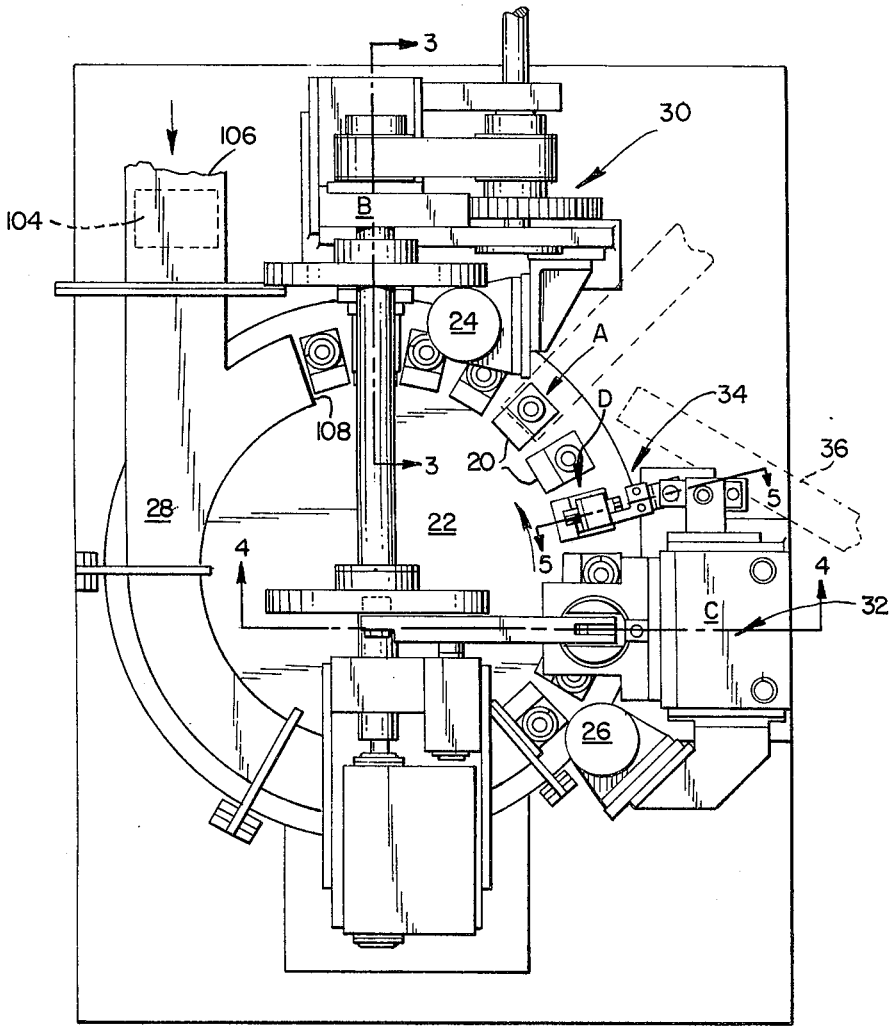
FIG. 2 is a plan view of the stress relieving apparatus.
Figure 5:
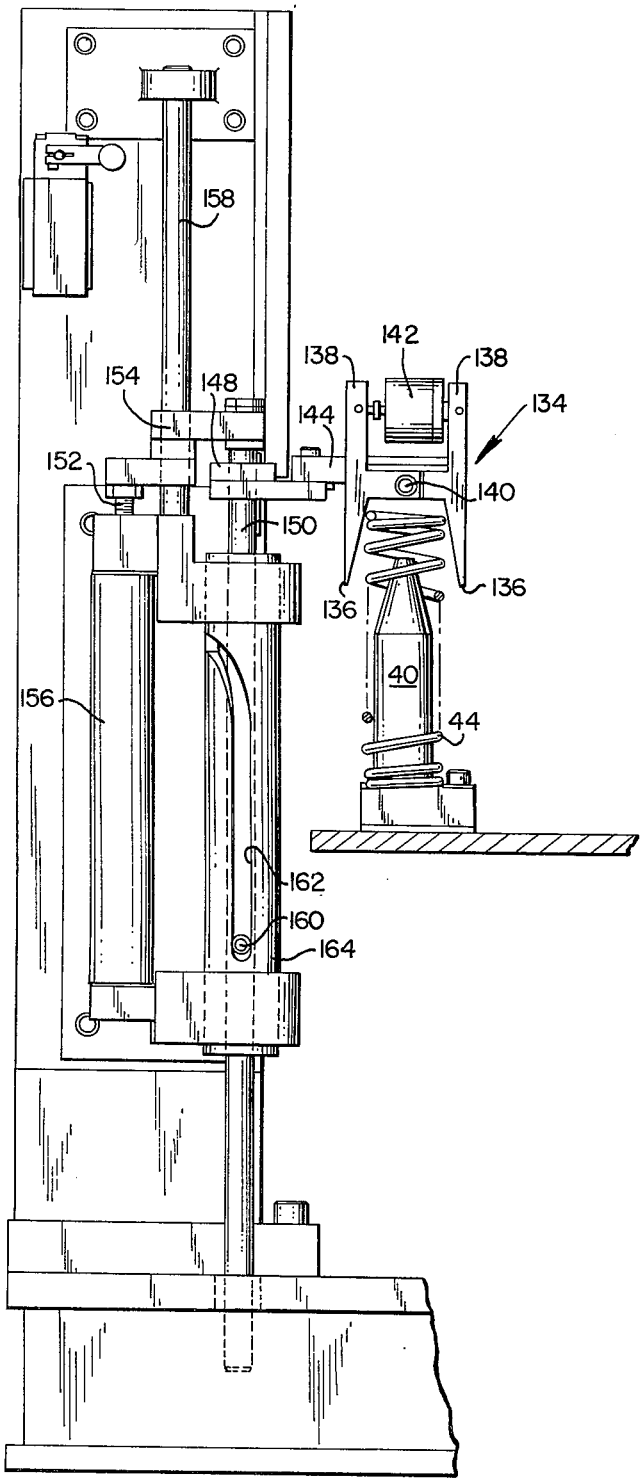
FIG. 5 is an enlarged vertical sectional view taken generally as indicated at 5—5 in FIG. 2 and illustrating a spring unloading device.
Figure 6:
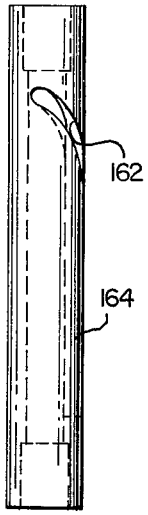
FIG. 6 is a view of a sleeve forming a part of the unloading device of FIG. 5.

When a spring has been set at the station C, counterclockwise movement of the table 22, FIG. 2, carries the same to the unloading station D mentioned above. In accordance with the invention, an unloading device at the station D comprises a spring gripping device indicated generally at 134 and which preferably takes the form of a scissors-like device having lower gripping members 136 and upper operating members 138 connected about a pivot point 140. A small air cylinder 142 is operatively associated with the members 138, 138 to move the gripping members 136, 136 into and out of engagement with a spring therebeneath. A member 144 carrying the gripping device 134 is adapted for vertical reciprocable movement and for swinging movement in a horizontal plane about an angle of approximately 90° from the full line position shown in FIG. 2 to an unloading position above a discharge chute 146, FIG. 2. Supporting linkage 148 for the member 144 is mounted on a slide rod 150 which is rotatable through an angle of 90° and which is vertically slidable at the urging of a piston rod 152 connected thereto by a linkage 154. The piston rod 152 is operated by a fluid cylinder 156 and a guide rod 158 carries the linkage 154 for vertical movement. Thus, it will be apparent that the cylinder 156 may be operated to urge the rod 152 upwardly and to carry the rod 150, the member 144 and the spring gripping device 134 upwardly. As the rod 150 moves upwardly, a small pin 160 mounted thereon travels along a slot 162 in a sleeve 164 about the rod. As will be apparent in a comparison of FIGS. 5 and 6, the slot 162 extends vertically upwardly but at an upper end portion turns arcuately through approximately 90°. Thus, as the rod moves upwardly, it is rotated through 90° whereby to swing the member 144 and the gripping device 134 to a position above the discharge chute 146. Subsequent operation of the small cylinder 142 releasing a spring 44 to the discharge chute completes the operation of the apparatus of the present invention.

From the foregoing, it will be apparent that a desirably simple and yet efficient spring stress relieving apparatus has been provided. The apparatus may be rendered wholly automatic through the provision of conventional limit switches, controls, etc. and a continuous and integrated manufacturing operation from the coil of spring wire, through a spring coiler, and including stress relieving and setting can be provided for.

We claim:

1. Apparatus for stress relieving springs and the like comprising a loading station, a device for delivering springs in succession to said loading station, a series of similar spring holders movable in a predetermined horizontal path which includes said loading station, each of said spring holders taking the form of an upright pin on and about which a coil spring may be deposited by said delivery means, and each of said holders also comprising an electrically conductive base member upon which a lower end portion of a coil spring rests when the spring is deposited on the pin, each said base member having an inclined seating surface and an associated short vertical abutment surface adjacent the lower end of the associated upright pin, said inclined surface being engageable with a side surface of a lower-most end coil of a spring supported on the pin, and said abutment surface being engageable with an end surface of such a coil, means for intermittently moving said holders along said path so that springs are successively deposited on said upright pins of said holders at said loading station, a stress relieving station in said predetermined path of movement, a spring indexiing device adjacent said predetermined path of movement between said loading and stress relieving stations, said device comprising an element engageable with and operable frictionally to rotate springs on said upright pins as they pass said device, the direction of rotation being such as to seat each spring with the side surface of the lower-most end coil in engagement with said inclined seating surface on said base member and with the end surface of said coil in engagement with the vertical abutment surface on said member, a pair of electrodes at said stress relieving station one of which comprises a spring holder base member at the station and both of which are engageable with a spring supported by a holder at the station, electrical power supply and control means connected with said electrodes and operable to effect resistance heating and thus to stress relieve a spring engaged by the electrodes, an unloading station in said predetermined path of movement, and a spring unloading device engageable with springs at said station and operable successively to remove the same from said holders.

2. Apparatus as set forth in claim 1 and including spring cooling means operable subsequent to said stress relieving operation and prior to unloading of the springs.

3. Apparatus as set forth in claim 2 wherein said cooling means comprises an air moving device and a communicating cooling tunnel arranged in said predetermined path of movement and having an entrance end downstream in said path from said stress relieving station for passage of holders and springs therethrough.

4. Apparatus as set forth in claim 1 and including a spring setting device at a spring setting station in said predetermined path of movement, said device comprising a ram movable toward and away from a spring on a holder at said station, said ram being engageable with a spring in its movement toward the spring and operable to compress and set the same.

5. Apparatus as set forth in claim 1 wherein said spring rotating element takes the form of a vertically mounted rotary brush engageable along a side surface of a spring and operable frictionally to rotate the same as aforesaid.

6. Apparatus as set forth in claim 5 wherein a spring setting device is provided at a spring setting station in said predetermined path of movement, said device comprising a vertically reciprocable ram disposed above and movable downwardly into engagement with a spring on a pin at said station, said ram being tubular in form to slide downwardly about an upper portion of said pin to compress and set said spring.

7. Apparatus as set forth in claim 6 wherein said unloading device comprises a spring gripping device movable into and out of engagement with a spring at said unloading station and operable to lift a spring from its pin and thus to discharge the same.

8. Apparatus as set forth in claim 7 wherein said unloading device comprises a vertically slidable member carrying said spring gripping device and which is rotatable through an angle of approximately 90° to and from a position above the spring and pin, and wherein said rotation is provided for by a rotatable slide rod supporting said member and a pin and arcuate slot means for rotating said rod.

9. Apparatus as set forth in claim 8 wherein a sleeve is provided about said slide rod and includes said arcuate slot, said rod being provided with a cooperating pin.

10. Apparatus as set forth in claim 9 wherein said predetermined path of movement takes a circular form, and wherein a rotary table supports said base members and upright pins in a circumaxially spaced series.

11. Apparatus as set forth in claim 1 wherein said pair of electrodes at said stress relieving station comprises a vertically slidable upper electrode engageable with an upper-most coil of a spring disposed on a pin therebeneath, and a two-part lower electrode, said electrically conductive base member forming one part thereof as aforesaid and a second part comprising a horizontally movable electrically conductive member electrically engageable with said one part when said upper electrode engages a spring.

12. Apparatus as set forth in claim 11 wherein said upper electrode is carried on a vertically reciprocable slide and said second part of said lower electrode is carried on an auxiliary vertical slide supported beneath and operable with said vertically reciprocable slide, said two slides being spring connected and said auxiliary slide being operable in downward movement to urge said second part of said lower electrode into electrical engagement with said first part as aforesaid.

13. Apparatus as set forth in claim 12 wherein said second part of said lower electrode and said auxiliary slide have complimentary surfaces inclined from the vertical and operable to move said part into engagement with said first electrode part on downward slide movement, said slide and second electrode part also having a pin-slot connection for horizontal retraction of the part on upward slide movement.

* * * * *